US006785496B2

(12) United States Patent
Iwata et al.

(10) Patent No.: US 6,785,496 B2
(45) Date of Patent: Aug. 31, 2004

(54) DEVELOPER CONTAINER, DEVELOPING CONVEYING DEVICE AND IMAGE FORMING APPARATUS USING THE SAME

(75) Inventors: Nobuo Iwata, Kanagawa (JP); Nobuo Kasahara, Kanagawa (JP); Satoshi Muramatsu, Kanagawa (JP); Junichi Matsumoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 67 days.

(21) Appl. No.: 10/152,672

(22) Filed: May 23, 2002

(65) Prior Publication Data

US 2003/0012586 A1 Jan. 16, 2003

(30) Foreign Application Priority Data

May 24, 2001 (JP) ..... 2001-155460
May 2, 2002 (JP) ..... 2002-130361

(51) Int. Cl.[7] ..... G03G 15/08
(52) U.S. Cl. ..... 399/258; 399/120
(58) Field of Search ..... 222/DIG. 1, 181.1, 222/181.2, 185.1; 399/258, 262, 263, 120, 107

(56) References Cited

U.S. PATENT DOCUMENTS

| | | | |
|---|---|---|---|
| 5,386,274 A | 1/1995 | Sanpe et al. | |
| 5,663,788 A | 9/1997 | Sanpe | |
| 5,875,380 A | 2/1999 | Iwata et al. | |
| 5,953,567 A | 9/1999 | Muramatsu et al. | |
| 5,962,783 A | 10/1999 | Iwata et al. | |
| 5,987,298 A | 11/1999 | Muramatsu et al. | |
| 6,112,046 A | 8/2000 | Suzuki et al. | |
| 6,128,459 A | 10/2000 | Iwata et al. | |
| 6,142,690 A | 11/2000 | Yoshimura et al. | |
| 6,163,669 A | 12/2000 | Aoki et al. | |
| 6,198,895 B1 | 3/2001 | Tsuda et al. | |
| 6,201,941 B1 | 3/2001 | Kasahara et al. | |
| 6,282,396 B1 | 8/2001 | Iwata et al. | |
| 6,295,437 B1 | 9/2001 | Hodoshima et al. | |
| 6,337,957 B1 | 1/2002 | Tamaki et al. | |
| 6,381,435 B2 | 4/2002 | Shinohara et al. | |
| 6,393,241 B1 | 5/2002 | Matsumoto et al. | |
| 6,501,913 B2 | 12/2002 | Hattori et al. | |
| 6,522,855 B1 | 2/2003 | Katoh et al. | |
| 6,549,744 B2 * | 4/2003 | Terazawa et al. | 399/262 |

FOREIGN PATENT DOCUMENTS

| | | |
|---|---|---|
| JP | 10-97130 | 4/1998 |
| JP | 2000-194182 | 7/2000 |
| JP | 2000-267412 | 9/2000 |
| JP | 2000-267414 | 9/2000 |
| JP | 2000-356898 | 12/2000 |

* cited by examiner

*Primary Examiner*—Hoang Ngo
(74) *Attorney, Agent, or Firm*—Oblon, Spivak, McClelland, Maier & Neustadt, P.C.

(57) ABSTRACT

A developer container of the present invention includes a flexible bag whose volume decreases in accordance with the decrease in pressure inside the bag. An outlet forming member forms an outlet for discharging a developer stored in the bag. When the volume of the bag decrease due to the drop of the pressure, a deformation assisting member helps the bag deform to a preselected shape. A developer conveying device and an image forming apparatus practicable with the developer container are also disclosed.

58 Claims, 14 Drawing Sheets

DEVELOPER CONTAINER, DEVELOPING CONVEYING DEVICE AND IMAGE FORMING APPARATUS USING THE SAME

BACKGROUND OF THE INVENTION

1. Field of the Invention

The present invention relates to a developer container of the type including a soft bag whose volume decreases with a decrease in pressure inside the bag, and an outlet forming member forming an outlet for discharging a developer stored in the bag. Also, the present invention relates to a developer conveying device for conveying the developer from the developer container to a developing replenishing device by use of a compressed gas, and an image forming apparatus including the same.

2. Description of the Background Art

An electrophotographic image forming apparatus of the type developing a latent image formed on a photoconductive drum or similar image carrier and transferring the resulting toner image to a sheet is conventional. It is a common practice with this type of image forming apparatus to use a toner container for replenishing fresh toner to a developing unit. Generally, the toner container is delivered to a user as a product independent of the image forming apparatus. This type of image forming apparatus often uses a screw, auger or similar mechanical means for replenishing toner from the toner container to a developing unit little by little. The problem with this kind of toner replenishing system is that a toner conveyance path must be substantially linearly arranged, obstructing free layout.

In light of the above, Japanese Patent Laid-Open Publication No. 7-219329 discloses a toner replenishing system including a screw pump and an air pump. The screw pump includes a rotor rotatable to convey toner in the axial direction and a stator enclosing the rotor while forming a passage between it and the rotor. The air pump sends compressed air to toner being conveyed by the screw pump in order to fluidize the toner. This kind of toner replenishing system promotes free layout of the toner conveyance path because compressed air can convey the toner from a toner container to a developing unit via a flexible tube. The toner container can therefore be provided with any desired shape and size matching with an idle space available in the image forming apparatus. Further, the toner is conveyed together with air and can therefore be stably fluidized and conveyed. In addition, no unnecessary stresses act on the toner during conveyance, so that the toner coheres or sticks little.

Moreover, the toner replenishing system taught in the above document makes it possible to implement the toner container as a flexible bag whose volume decreases with a decrease in pressure inside the bag, which occurs due to the suction of the screw pump. The flexible bag therefore collapses in a compact configuration when run out of toner and is therefore easy to handle. By contrast, a toner cartridge or a hard bottle, which is another specific form of the toner container, does not deform and therefore remains in the same size even when run out of toner. The toner replenishing system taught in the above document allows a soft bottle formed of a soft material to be used. The soft bottle whose volume decreases when run out of toner is easy for the user to handle. In addition, a minimum of cost is necessary for the soft bottle to be transported from the user's station to the manufacturer's station.

However, the soft bottle does not collapse in a regular shape, but collapses in an irregular shape as if it were twisted. This impairs the merit of the collapsible toner container as to storage and transport. Moreover, the soft bottle collapsed in an irregular shape is not attractive in appearance or easy to handle.

The toner replenishing system proposed in the above document can convey the toner out of the toner container only with the suction of the screw pump. However, a problem is that the toner deposited on the inner periphery of the toner container does not reach the outlet of the toner container despite the suction, but remains in the toner container in the form of blocks (toner blocking), depending on the shape of the container. To cope with toner blocking, air under pressure may be sent from an air pump into the toner container in parallel with the suction of the screw pump for thereby agitating the toner and removing the toner from the inner periphery of the container. However, while the toner around the outlet of the toner container, in particular, must be surely fluidized, even the combined suction and air scheme fails to surely fluidize it, depending on the shape of the toner container and the air sending system.

Technologies relating to the present invention are also disclosed in, e.g., Japanese Patent Laid-Open Publication Nos. 10-97130, 2000-194182, 2000-267412, 2000-267414, and 2000-356898.

SUMMARY OF THE INVENTION

It is an object of the present invention to provide a developer container easy to handle, store and transport when run out of a developer, and an image forming apparatus using the same.

It is another object of the present invention to provide a developer conveying device capable of agitating and sufficiently fluidizing toner stored in a toner container by sending compressed air or similar gas into the toner container, and an image forming apparatus using the same.

In accordance with the present invention, a developer container includes a flexible bag whose volume decreases in accordance with the decrease in pressure inside the bag. An outlet forming member forms an outlet for discharging a developer stored in the bag. When the volume of the bag decrease due to the drop of the pressure, a deformation assisting member helps the bag deform to a preselected shape.

Also, in accordance with the present invention, a developer conveying device includes a gas sending device for sending a gas under pressure. An air supply passage guides the gas delivered from the gas sending device to a developer container, which stores a developer therein, via a plurality of gas outlets. A developer passage is formed with a developer inlet for discharging the developer from the developer container. A controller controls the individual flows of the gas into the developer container via the plurality of gas inlets.

An image forming apparatus using the above developer container and including the above developer conveying device is also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
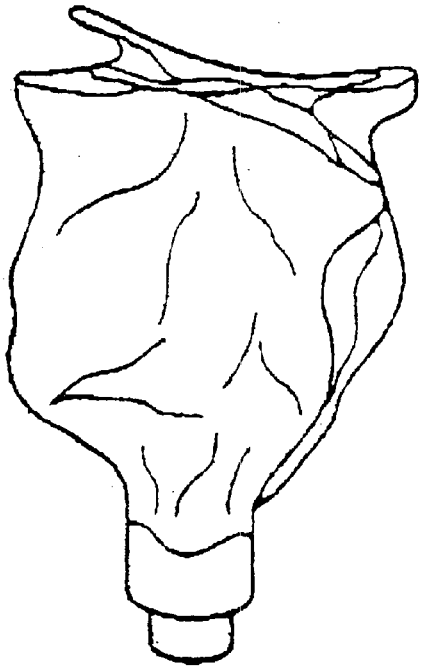
FIG. 1 PRIOR ART
FIG. 1 is an isometric view showing a conventional toner container collapsed due to the consumption of toner.

To better understand the present invention, the problems of the conventional technologies will be described more specifically hereinafter. First, as shown in FIG. 1, a soft bottle mentioned earlier does not collapse in a regular shape, but collapses in an irregular shape as if it were twisted. This impairs the merit of the collapsible toner container as to storage and transport.

To allow the entire toner existing in a toner container to reach the outlet of the toner container, it is particularly important to surely fluidize toner around the outlet. However, such toner sometimes cannot be fluidized, depending on the shape of the toner container and the air sending system.

Figure 2:
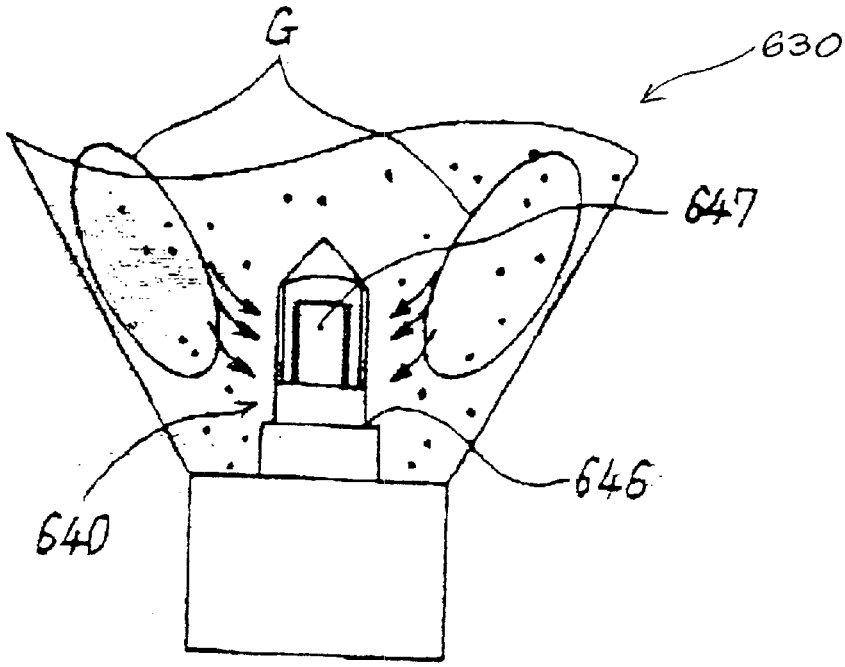
FIG. 2 PRIOR ART
FIG. 2 shows an undesirable condition to occur in a toner container when air is sent into the toner container by a conventional system.

FIG. 2 shows a condition occurring in a toner container 630 when a conventional air sending system sends air into the toner container. As shown, a nozzle 640 is vertically inserted into the toner container 630 and includes a toner outlet 647 and an air inlet 646. The nozzle 640 has a double-wall structure made up of an inner tube and an outer tube surrounding the inner tube, although not shown specifically. The bore of the inner tube and the space between the inner and outer tubes constitute a toner passage and an air passage, respectively. The problem with this configuration is that it is difficult for air flowing into the toner container 630 via the air inlet 646 to reach regions G. As a result, toner present in the regions G cannot be delivered from the toner container 630.

Figure 4:
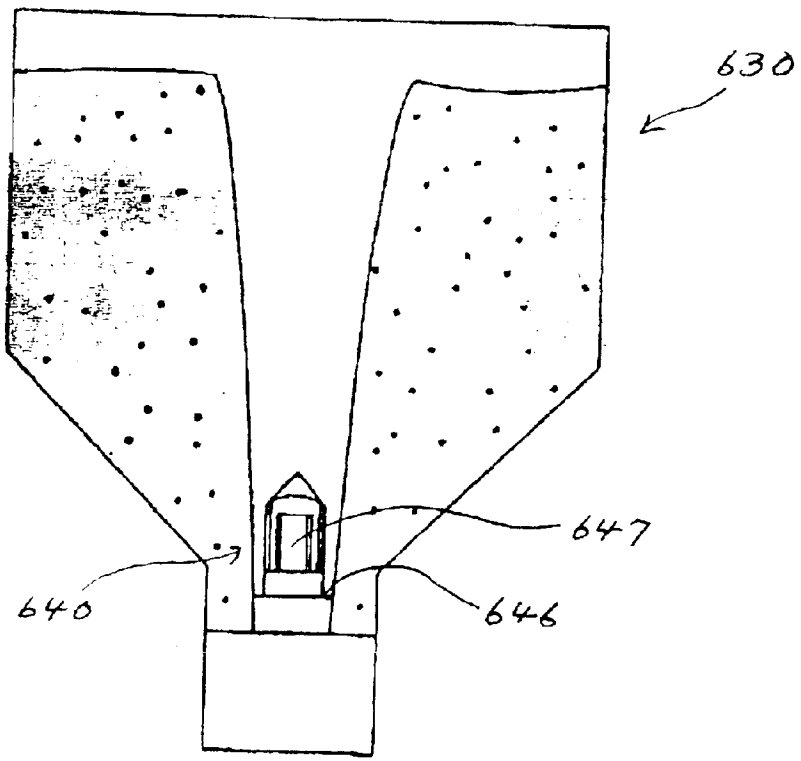
FIG. 4 PRIOR ART
FIG. 4 shows another specific condition of bridging to occur in the toner container.
Figure 3:
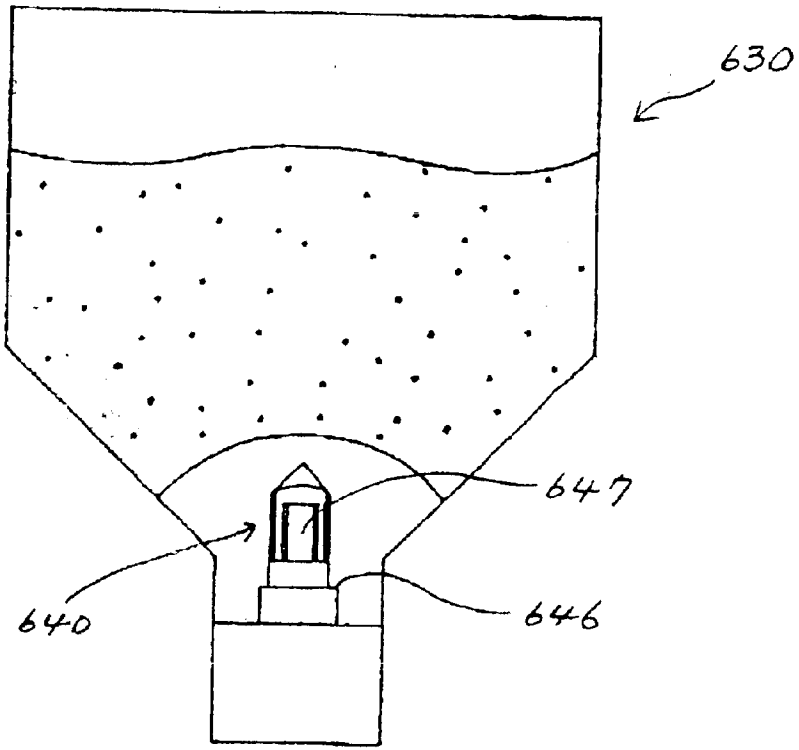
FIG. 3 PRIOR ART
FIG. 3 shows a specific condition of bridging to occur in the toner container.

Even if toner around the toner outlet 647 of the nozzle 640 is successfully fluidized, toner bridging that makes the portion around the toner outlet 647 hollow is likely to occur. FIG. 3 shows a specific condition of toner bridging in which an arch-like hollow is formed around the toner outlet 647 due to toner bridging. FIG. 4 shows another specific condition of toner bridging in which only toner vertically above the nozzle 640 is discharged via the toner outlet 647, leaving a so-called rat' hall in the toner container 630. In any case, toner bridging is apt to occur when the toner is not fluidized over a broad range or when use is made of toner extremely low in fluidity. Moreover, once toner bridging occurs, air flowing into the toner container is likely to practically fail to agitate the toner.

In light of the above, there has been proposed an air sending system in which an air pump sends air into the toner container 630 via a plurality of positions. This kind of air sending system allows air to agitate the toner in the toner container 630 over a broad range for thereby effectively obstructing toner blocking. More specifically, a plurality of air inlets 646 are formed in the toner container 630.

However, the above air sending system uses a single air pump for sending air to a plurality of air inlets 646. Experiments showed that when the pressure of the toner acting on the air inlets 646 was uneven, air flew into the toner container 630 only via the air inlet where the load was lightest, while leaving the other air inlet stopped by the toner. Consequently, only one of the air inlets 646 functions and prevents air from fluidizing the toner in the toner container 630 over a broad range.

Preferred embodiments of the present invention free from the problems described above will be described hereinafter.

First Embodiment

Figure 5:
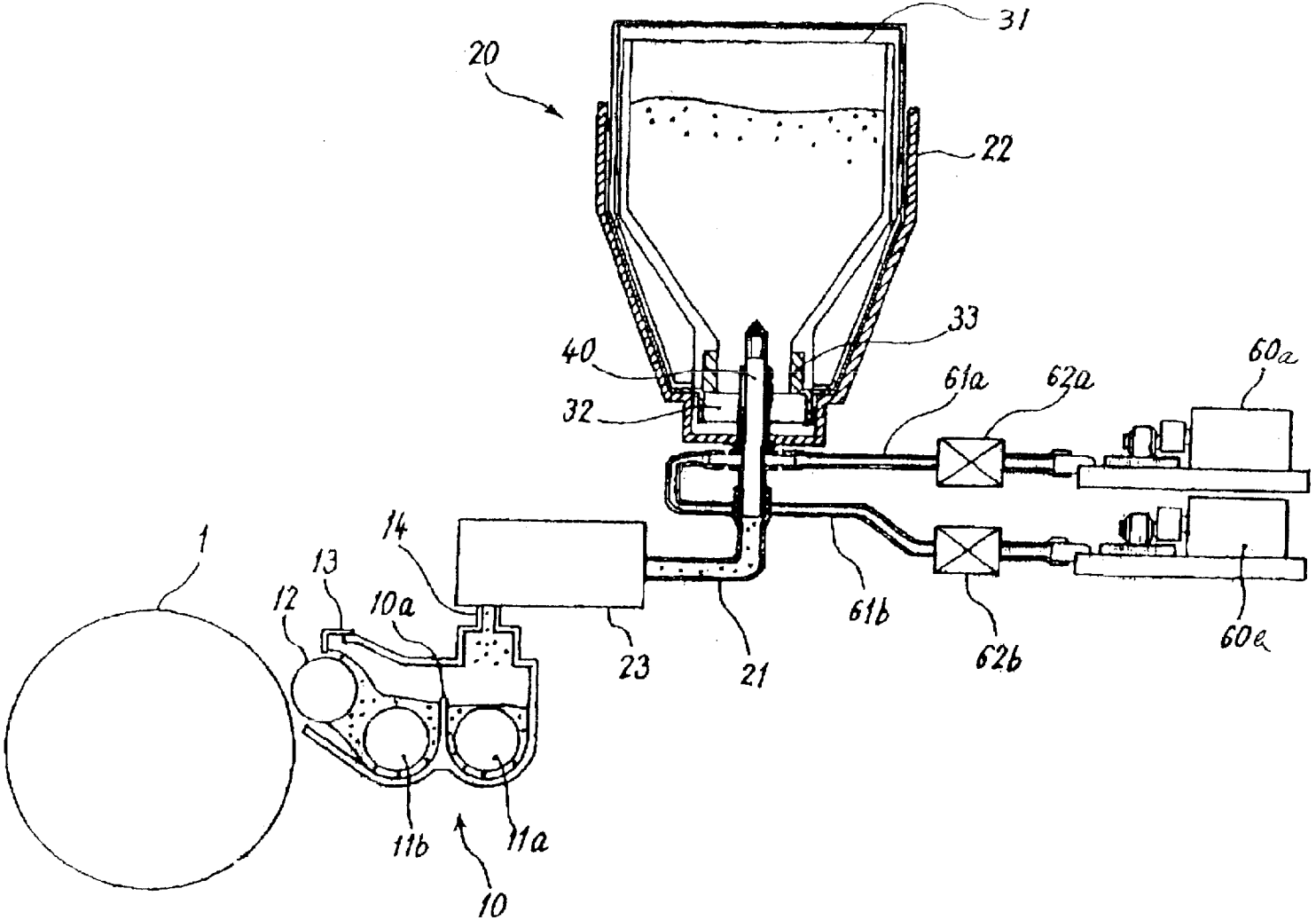
FIG. 5 is a view showing a toner replenishing device included in a first embodiment of the image forming apparatus in accordance with the present invention.

A first embodiment of the present invention is applied to an electrophotographic, monochromatic printer including a single developing unit. First, the general construction and operation of the printer will be described with reference to FIG. 5. FIG. 5 shows a toner or developer replenishing device, which is a specific form of a developer conveying device included in the printer. As shown, the printer includes a photoconductive drum or image carrier 1. A charger, not shown, uniformly charges the surface of the drum 1 to a preselected potential. An optical writing unit, not shown, scans the charged surface of the drum 1 with a light beam in accordance with image data, thereby forming a latent image on the drum 1. A developing unit 10 develops the latent image with toner to thereby produce a corresponding toner image. The toner image is transferred from the drum 1 to a sheet or recording medium, not shown, and then fixed on the sheet by a fixing unit not shown. Such an electrophotographic image forming process is conventional.

The developing unit 10 is of the type using a two-ingredient type developer, i.e., a toner and carrier mixture. The inside of the developing unit 10 is divided into two chambers by a partition 10*a*. Screws 11*a* and 11*b* are respectively disposed in the two chambers, and each agitates the developer in the chamber while circulating it in the chamber. When the developer is brought to the vicinity of a sleeve or developer carrier 12, a magnet roller, not shown, disposed in the sleeve 12 causes the developer to magnetically deposit on the sleeve 12. The sleeve 12 in rotation conveys the developer deposited thereon to a developing position where the sleeve 12 faces the drum 1. At this instant, a doctor blade 13 regulates the developer so as to cause it to form a thin layer.

At the developing position, only the toner contained in the developer is transferred from the sleeve 12 to the latent image formed on the drum 1. As a result, the toner in the developer is consumed as the development is repeated. In the illustrative embodiment, to maintain the toner content of the developer, the toner replenishing device, generally 20, replenishes fresh toner to the developing unit 10 via a port 14 little by little.

The toner replenishing device 20 includes a screw pump 23 communicated to the port 14 of the developing unit 10. A tube 23 is communicated to the screw pump 23 and forms a toner passage or developer passage. The tube 23 should preferably be formed of polyurethane rubber, nitril rubber, EPDM or similar rubber that is flexible and highly resistant to the toner. A holder 22 supports a toner container or developer container 30 and is formed of resin or similar highly rigid material.

The toner container 30 is generally made up of a toner or developer storing portion 31 and a mouth portion 32. The toner storing portion 31 is implemented as a bag formed of a flexible sheet material. The mouth portion 32 plays the role of an outlet forming member that forms a toner outlet or developer outlet. The toner container 31 should preferably be implemented by polyethylene sheets, polyester sheets, polyurethane sheets or similar plastic sheets. A seal member 33 is fitted in the mouth portion 32 and formed with a cruciform cut. A nozzle 40 is inserted into the toner container 30 via the cut of the seal member 33, providing fluid communication between the toner container 30 and the toner replenishing device 20. With the above configuration, the toner container 30 can be easily replaced without any leakage of the toner when it runs out of the toner.

Figure 6A:
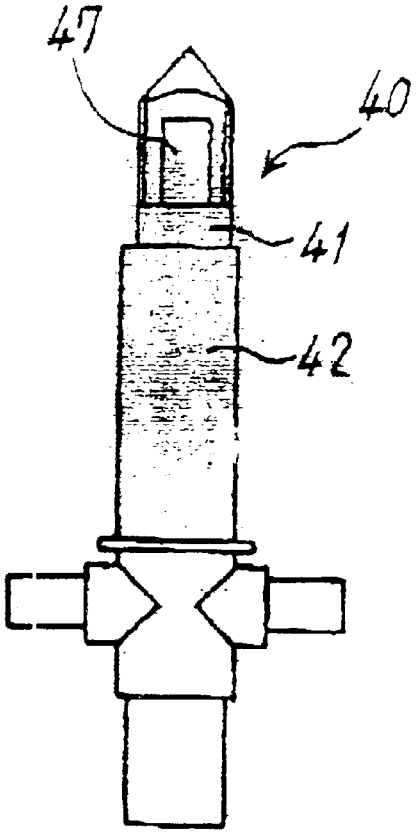
FIG. 6A is an external view of a nozzle included in the toner replenishing device.
Figure 6B:
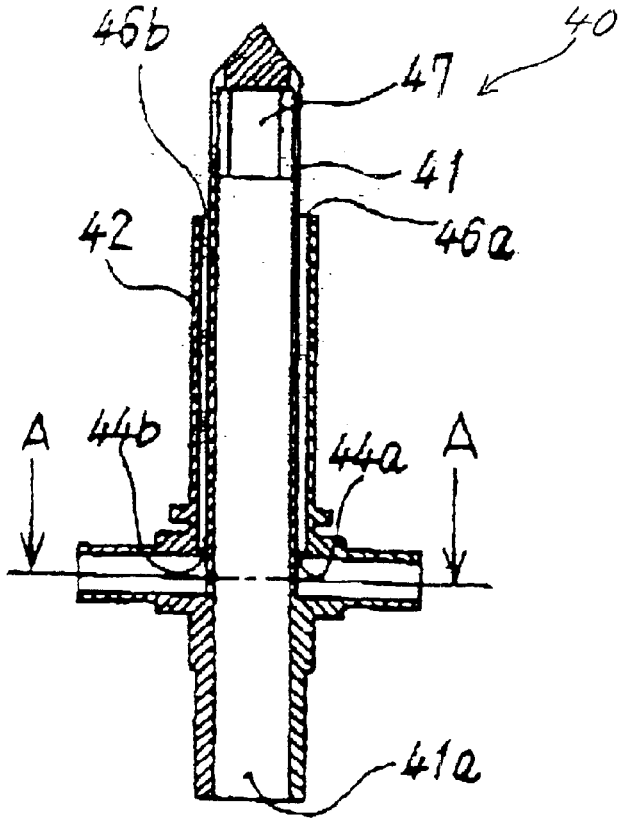
FIG. 6B is a section of the nozzle in the axial direction.
Figure 6C:
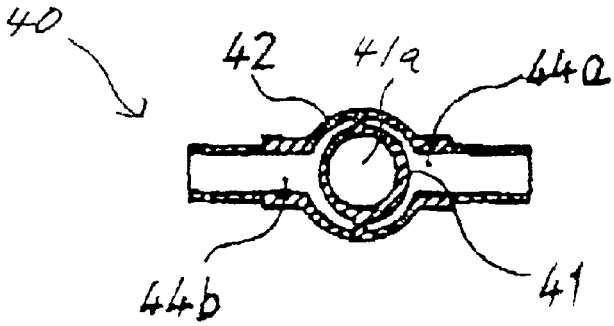
FIG. 6C is a section along line A—A of FIG. 6B.

As shown in FIGS. 6A through 6C, the nozzle 40 has a double-wall structure made up of an inner tube 41 and an outer tube 42 surrounding the inner tube 41. The inner tube 41 forms a toner passage or developer passage 41*a* for the delivery of the toner from the toner container 30. The screw pump 23 sucks the toner out of the toner container 30 via the nozzle 40.

Figure 7:
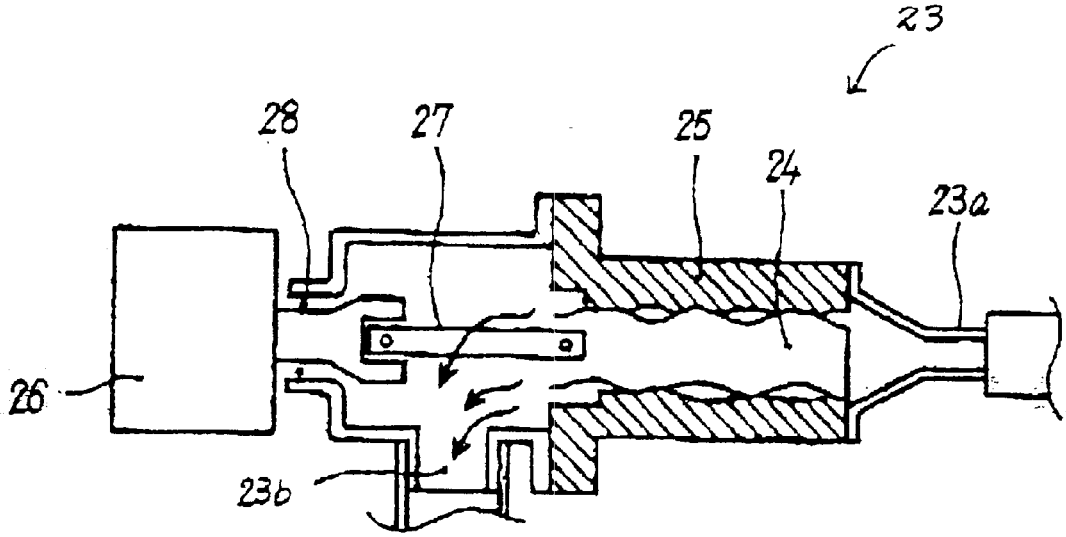
FIG. 7 is a section showing a screw pump included in the toner replenishing device.

FIG. 7 shows the screw pump, or so-called single-axis eccentric screw pump, 23 specifically. As shown, the screw pump 23 has a rotor 24 and a stator 25 there inside. The rotor 24 has a spirally twisted, circular section and is received in the stator 25. The rotor 24 is formed of a hard material. The stator 25, which is formed of a rubber-like soft material, is formed with a bore having a spirally twisted, oblong section. The rotor 24 is received in the bore of the stator 25. The spiral of the stator 25 has a pitch two times as great as the pitch of the spiral of the rotor 24. The rotor 24 is connected to a drive motor 26 via a universal joint 27 and a bearing 28.

In the above configuration, the toner conveyed from the toner container 30 via the toner passage 31*a* of the nozzle 40 and tube 21 flows into the screw pump 23, i.e., a space between the rotor 24 and the stator 25 via an inlet 23*a*. The rotor 24 in rotation conveys the toner to the right-hand side as viewed in FIG. 7. The toner then drops via an outlet 23*b* and enters the developing unit 10 via the port 14, FIG. 5.

As shown in FIG. 6B, in the nozzle 40, the inner tube 41 and outer tube 42 form an annular air passage therebetween. As shown in FIG. 6C, the air passage is implemented as two passages 44*a* and 44*b* isolated from each other and having a semicircular section each. As shown in FIG. 5, air pumps or air sending units 60*a* and 60*b* are respectively communicated to the air passages 44*a* and 44*b* via air supply passages 61*a* and 61*b*. The air pumps 60*a* and 60*b* each may be implemented as a conventional, diaphragm type air pump. Streams of air delivered from the pumps 60*a* and 60*b* are sent into the toner container 30 via the air supply passages 61*a* and 61*b*, air passages 44*a* and 44*b* and air outlets 46*a* and 46*b*, respectively. The air outlets 46*a* and 46*b* are positioned below a toner inlet 47, as viewed in FIG. 6B, from which the toner passage 41*a* extends. In this configuration, air flowing into the toner container 30 via the air outlets 46*a* and 46*b* hits against the toner around the toner inlet 47. Therefore, even when the toner inlet 47 is stopped by the toner due to the long suspension of operation, the above air successfully loosens the toner.

As shown in FIG. 5, valves or blocking means 62*a* and 62*b* are respectively disposed in the air supply passages 61*a* and 61*b*, and each selectively opens or closes in response to a control signal fed from a controller or air delivery control means not shown. More specifically, each valve 62*a* or 62*b* opens to unblock the associated path 61*a* or 61*b* on receiving an ON signal or closes to unblock it on receiving an OFF signal.

The operation of the toner replenishing device will be described hereinafter. When the controller receives a signal representative of short toner content from the developing device 10, the controller starts replenishing the fresh toner. First, the controller drives the air pumps 60*a* and 60*b* to send air into the toner container 30 and drives the drive motor 26 to cause the screw pump 23 to suck the toner from the toner container 30. Air sent from the air pumps 60*a* and 60*b* flows into the toner container 30 via the air supply passages 61*a* and 61*b*, air passages 44*a* and 44*b*, and air outlets 46*a* and 46*b*. Such air agitates the toner in the toner container 30 for thereby fluidizing it.

Further, air flown into the toner container 30 raises pressure inside the toner container 30. The resulting difference between the pressure inside the toner container 30 and the pressure outside the same (atmospheric pressure) causes the toner to flow out of the toner container 30 via the toner outlet 47. At this instant, the suction of the screw pump 23 also acts on the toner.

The toner flown out of the toner container 30 is delivered to the screw pump 23 via the toner passage 41*a* of the nozzle 40 and tube 21 and then delivered from the screw pump 23 to the developing unit 10 via the port 14. On the replenishment of a preselected amount of toner, the controller stops driving the air pumps 60*a* and 60*b* and drive motor 26 and closes the valves 62*a* and 62*b* to thereby end toner replenishment. The valves 62*a* and 62*b* so closed prevent the toner from flowing from the toner container 30 toward the air pumps 60*a* and 60*b* via the air passages 44*a* and 44*b* of the nozzle 40.

The amount of air sent from the air pumps 60*a* and 60*b* is selected to be smaller than the amount of air sucked by the screw pump 23. Therefore, the pressure inside the toner container 30 drops due to toner consumption. In the illustrative embodiment, the toner storing portion 31 of the toner container 30 is implemented by flexible sheets and therefore decreases in volume in accordance with the drop of the pressure inside the container 30.

Figure 8A:
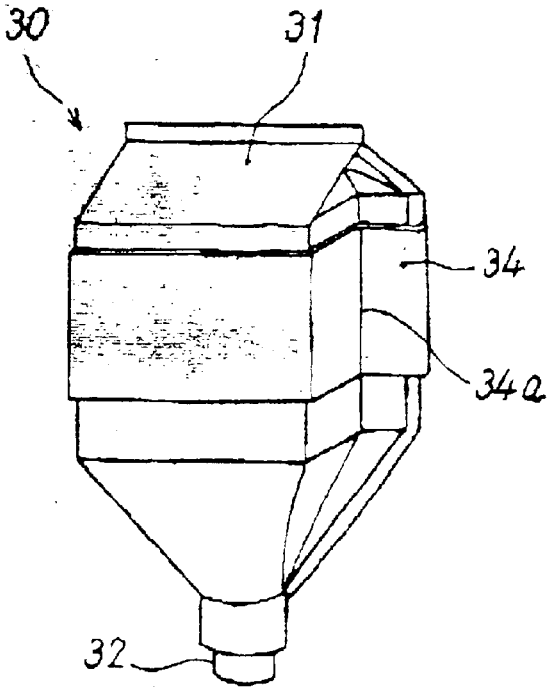
FIG. 8A is a perspective view showing a toner container included in the illustrative embodiment and packed with toner.
Figure 8B:
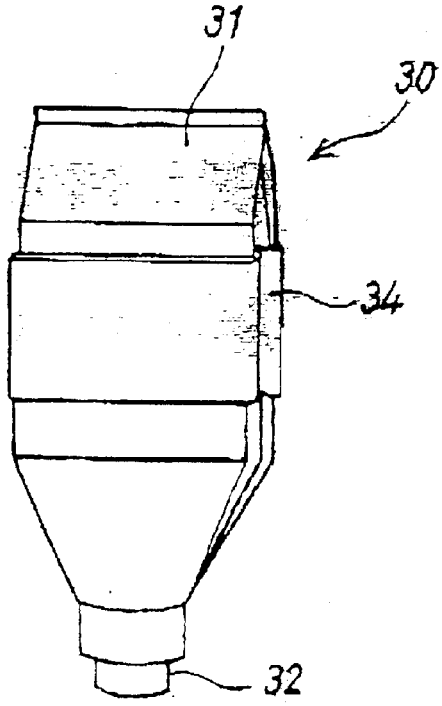
FIG. 8B is a perspective view showing the toner container of FIG. 8A collapsed due to the consumption of toner.

FIGS. 8A and 8B show a specific configuration of the toner container 30. FIG. 8A shows the toner container 30 packed with toner while FIG. 8B shows it run out of toner. As shown, a guide member or deformation assisting member 34 is removably fitted on part of the toner storing portion 31 in order to help the toner container 30 deform in accordance with the decrease in volume.

Figure 9B:
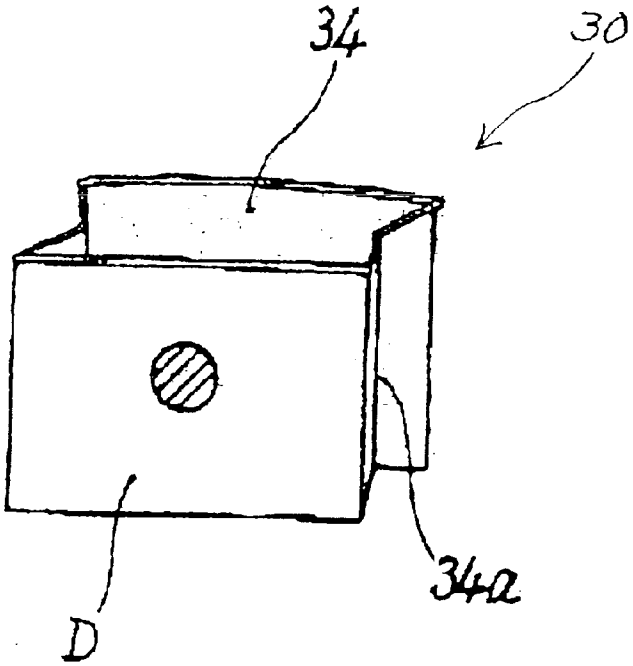
FIGS. 9A and 9B are isometric views respectively showing the toner container and a guide member separated from each other.
Figure 9A:
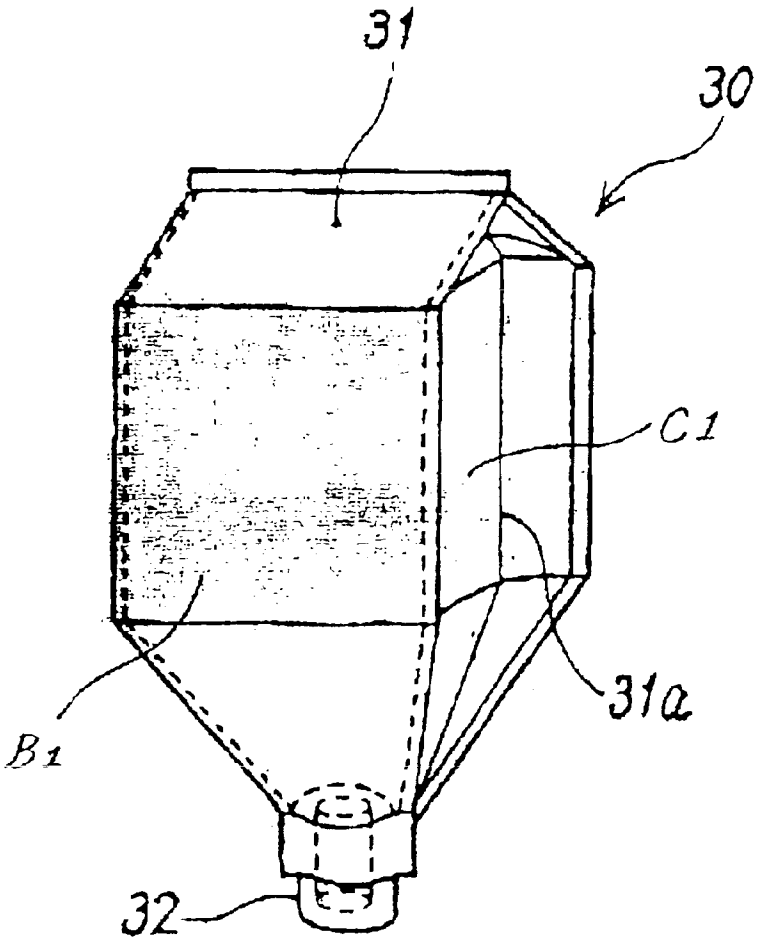

FIGS. 9A and 9B respectively show the toner container 30 and guide member 34 separated from each other. As shown in FIG. 9A, the toner storing portion 31 is formed by fusion bonding or otherwise connecting polyethylene sheets. The mouth portion 32 is affixed to the toner storing portion 31 by fusion bonding. Fusion bonding is desirable from the hermetic sealing standpoint although it may be replaced with any other suitable technology.

As shown in FIG. 9A, the toner storing portion 31 includes two, first flat walls B1 and B2 (B2 is not visible) facing each other and two, second flat walls C1 and C2 (C2 is not visible) facing each other. Each second flat wall C1 or C2 is formed with a fold 31*a* such that it approaches the other second flat wall in a parallel relation when the toner container 30 deforms due to a decrease in volume. The toner container 30 is generally referred to as a gazette container and can be easily folded.

The guide member 34 shown in FIG. 9B is formed of, e.g., a relatively thick paper sheet or a thin plastic sheet higher in rigidity than the toner container 30. The guide member 34 is a hollow member having a substantially square section. Two walls of the guide member 34 facing each other is formed with a fold 34*a* each. The walls with the folds 34*a* easily bend along the folds 34*a* when subjected to a weak force. As shown in FIG. 8A, the guide member 34 is coupled over the toner storing portion 31 such that the folds 34*a* coincide with the folds 31*a*. When the volume of the toner container 30 decreases, the resulting pressure causes the guide member 34 to yield along the folds 34*a*. The folds 34*a* therefore push the folds 31*a* of the toner container 30 inward while the inner surfaces of the guide member 34 evenly push the flat portions of the toner container 30 in the normal direction. In this manner, the guide member 34 helps the toner container 30 deform due the decreased volume. As a result, the toner container 30 is neatly folded down in the form of a sheet, as shown in FIG. 8B.

If desired, the inner surface of one wall D, FIG. 9B, forming part of the guide member 34 may be coated with adhesive so as to affix the guide member 34 to the toner container 30. Alternatively, the guide member 34 and toner container 30 may be affixed to each other by fusion bonding. Such an affixing scheme prevents the guide member 34 from slipping out of the toner container 30 or from being displaced during transport, when the toner container 30 is mounted to the printer or during operation after the mounting of the toner container 30.

As stated above, the toner container 30, except for the mouth portion 32, is automatically folded down in the form of a flat sheet when run out of the toner. This not only facilitates the replacement of the toner container 30 by the user, but also promotes efficient storage of used toner containers 30 and efficient collection by the manufacturer.

First Modification

Figure 10:
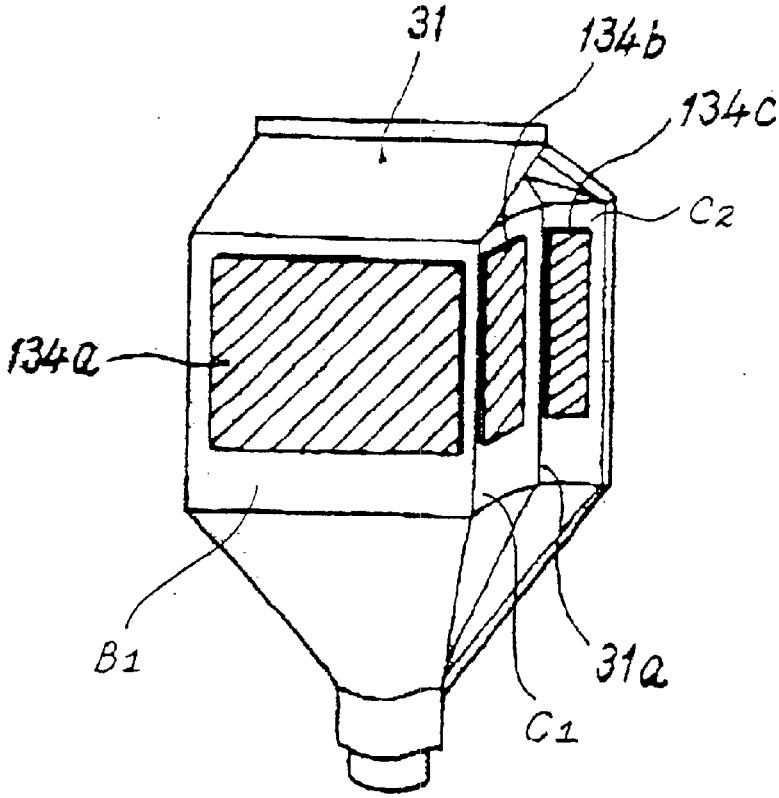
FIG. 10 shows a guide member representative of a first modification of the illustrative embodiment.
Figure 11A:
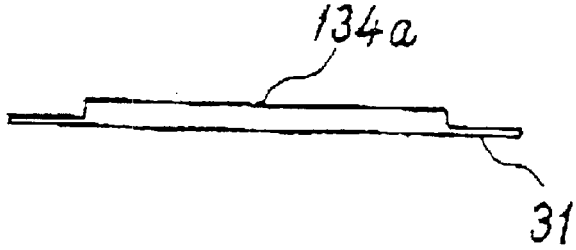
FIG. 11A is a section showing a specific configuration of the guide member shown in FIG. 10.
Figure 11B:
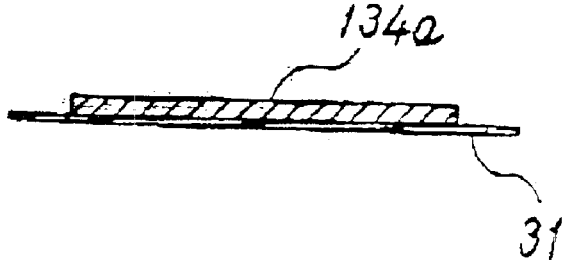
FIG. 11B is a section showing another specific configuration of the guide member.

FIG. 10 shows a guide member representative of a first modification of the illustrative embodiment. As shown, the guide member is made up of six flat members 134*a* through 134*c*. While only three flat members 134*a* through 134*c* are visible, the other three flat members 134*a* through 134*c* are positioned on the other walls of the toner container 30 also. As shown in FIG. 11A, the flat member 134*a*, as well as the other flat members 134*b* and 134*c*, may be formed integrally with the toner storing portion 31, i.e., by increasing the thickness of the toner storing portion 31. Alternatively, as shown in FIG. 11B, the flat member 134*a*, as well as the other flat members 134*b* and 134*c*, may be implemented as a sheet or a plate separate from the toner storing portion 31 and adhered or fusion-bonded to the outer periphery of the toner storing portion 31.

More specifically, one flat member 134*a* is positioned on each of two walls B1 and B2 (only B1 is visible) of the toner container 30 facing each other. Two flat members 134*b* and 134*c* are respectively positioned on two portions C1 and C2 of each wall adjoining each other at both sides of the fold 31*a*. The flat members 134*a* through 134*c* constitute reinforcing means. Therefore, the portions of the toner container 30 with the guide members 134*a* through 134*c* are more rigid than the other portions, implementing the same advantages as the illustrative embodiment.

Second Modification

Figure 12:
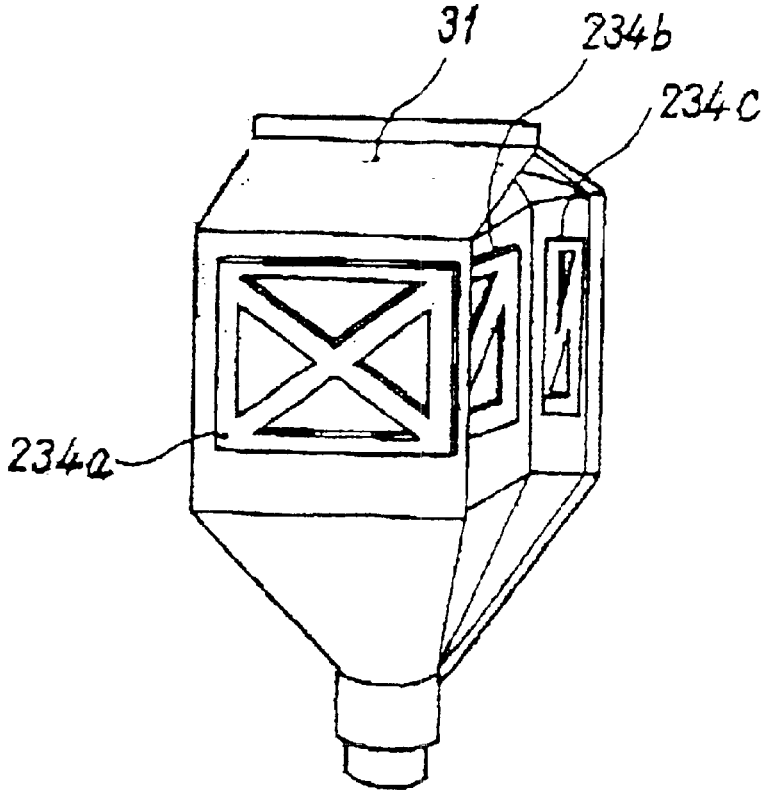
FIG. 12 shows a guide member representative of a second modification of the illustrative embodiment.
Figure 13A:
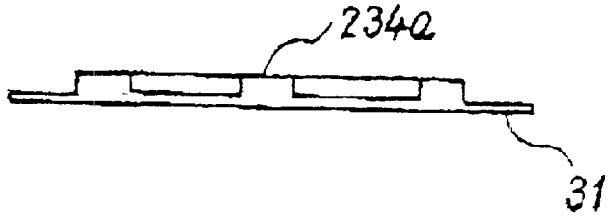
FIG. 13A is a section showing a specific configuration of the guide member shown in FIG. 12.
Figure 13B:
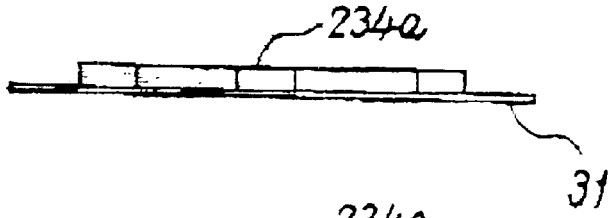
FIG. 13B is a section showing another specific configuration of the guide member.
Figure 13C:
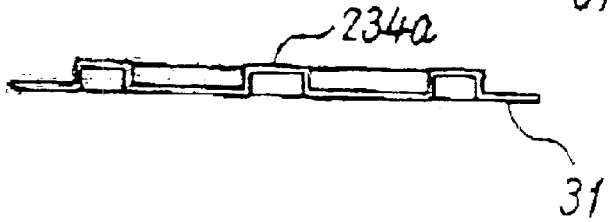
FIG. 13C is a section showing still another specific configuration of the guide member.

FIG. 12 shows a guide member representative of a second modification of the illustrative embodiment. As shown, the guide member includes six flat members 234*a* through 234*c* identical in position and function with the flat members 134*a* through 134*c* of the first modification. The flat members 234*a* through 234*c* differ from the flat members 134*a* through 134*c* in that they are perforated, as illustrated. As shown in FIG. 13*a*, the flat member 234*a*, as well as the other flat members 234*b* and 234*c*, may be formed integrally with the toner storing member 31, i.e., by increasing the thickness of the toner storing member 31. Alternatively, as shown in FIG. 13B, the flat member 234*a*, as well as the other flat members 234*b* and 234*c*, may be implemented as a sheet or a plate separate from the toner storing portion 31 and adhered or fusion-bonded to the outer periphery of the toner storing portion 31. Further, as shown in FIG. 13C, the sheets constituting the toner storing portion 31 may be processed to form projections and recesses. In any case, the perforations of the flat members 234*a* through 234*c* reduce the total weight of the toner container 30 and facilitates handling.

Third Modification

Figure 15:
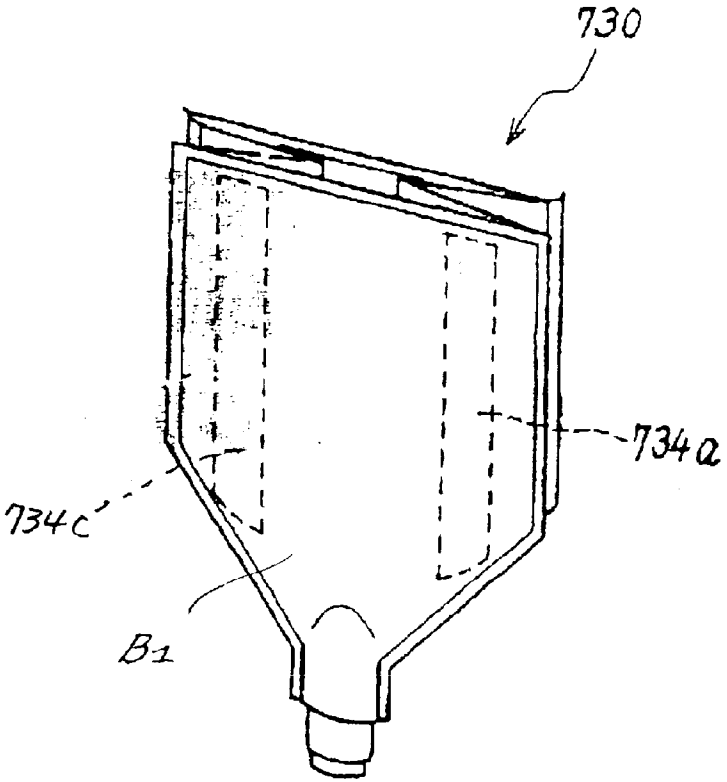
FIG. 15 is an external view showing the toner container of the third modification folded down in a sheet-like configuration.
Figure 14:
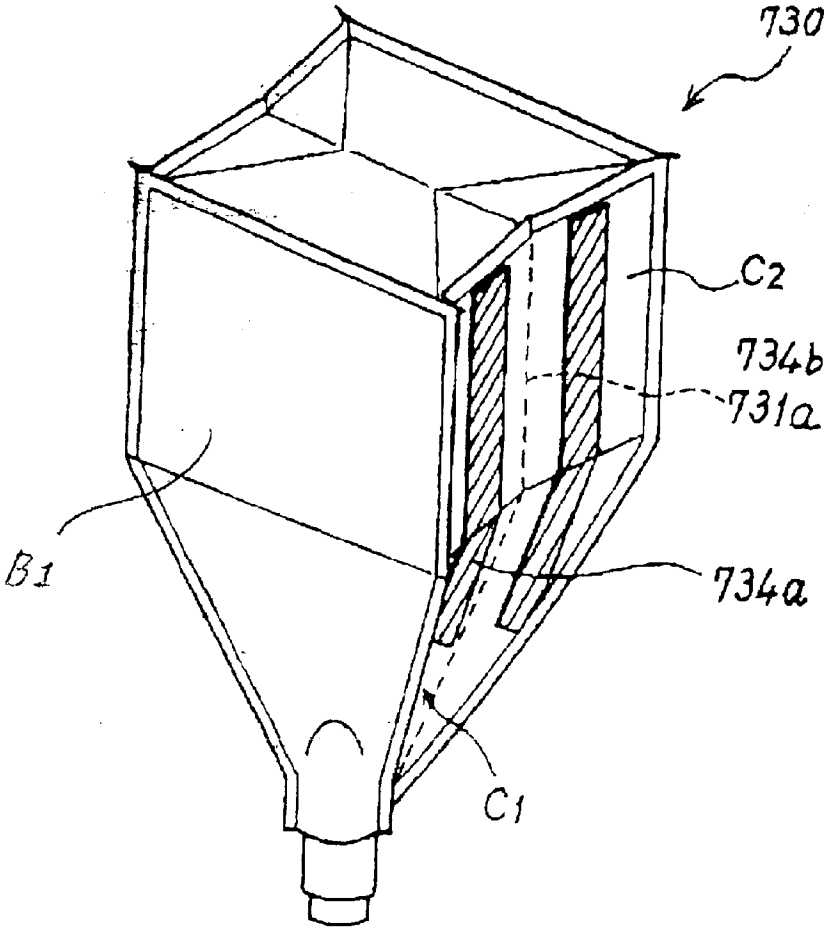
FIG. 14 shows a guide member representative of a third modification of the illustrative embodiment.

FIGS. 14 and 15 show a toner container 730 representative of a third modification of the illustrative embodiment. The toner container 730 also is a so-called gazette container, but differs from the first embodiment and first and second modifications thereof in the following respect. In the first embodiment and modifications thereof described above, the toner container 30 is folded down in the form of a sheet with its top protruding outward when run out of toner. By contrast, as shown in FIG. 15, the toner container 730 is folded down in the form of a sheet with its top collapsing inward. The toner container 730 is therefore shorter in the up-and-down direction than the toner container 30 of the illustrative embodiment and the first and second modifications when folded down. This further facilitates the handling and storage of the used toner container 30.

Further, as for the toner container 30, the printer needs an extra space for accommodating the top of the toner container 30 protruding outward as stated above. The third modification makes such an extra space needless because the top of the toner container 730 collapses inward, successfully reducing the overall size of the printer. It is to be noted that the third modification may be applied to any one of the illustrative embodiment and the first and second modifications thereof or may be provided with the configuration of the toner container 30, if desired.

As shown in FIG. 14, the toner container 730 includes two first walls B1 and B2 (only B1 is visible) facing each other and connected together by two second walls (only one is visible). Each wall connecting the first walls B1 and B2 has two portions C1 and C2 separate from each other in the direction in which the first walls B1 and B2 face each other. A first and a second flat member 734*a* and 734*b* are positioned on the portions C1 and C2, respectively. It is to be noted that other two flat members 734*a* and 734*b* are positioned on the other wall connecting the first walls Bland B2 although not visible. The four flat members 734*a* and 734*b* constitute a guide member.

In the third modification, the first walls B1 and B2 are not provided with any guide member, but are provided with greater thickness than the portions C1 and C2 of the second walls. Therefore, as shown in FIG. 15, the first walls B1 and B2 remain flat even when the toner container 730 is folded down due to a decrease in volume.

The portions C1 and C2 of each second wall are not formed with any fold, but are implemented by relatively thin, flexible sheets and provided with the flat members 734*a* and 734*b*. If the flat members 734*a* and 734*b* are absent in the portions C1 and C2, then the second wall would fold in the form of bellows and would thereby prevent the toner container 730 from having the expected shape or the expected thickness when folded down. In the third modification, the rigid, flat members 734*a* and 734*b* help the portions C1 and C2 fold at the center 731*a* between them. Such a guide member therefore achieves the same advantages as the guide member 34 of the first embodiment. If desired, the folds particular to the illustrative embodiment and the first and second modifications thereof may also be applied to the portions C1 and C2 in order to further stabilize the shape of the toner container 730 after deformation.

Only one of the flat members 734*a* and 734*b* may be positioned in either one of the two portions C1 and C2 of each second wall, if desired. Even a single flat member can successfully help the associated portion C1 or C2 yield inward while pulling the other portion inward.

The flat members 734*a* and 734*b* may be formed integrally with the toner storing portion of the toner container 730 or may be implemented as sheets or plates separate from the toner container 730 as in the illustrative embodiment and the first and second modifications thereof. Alternatively, the flat members 734*a* and 734*b* may be implemented by forming projections and recesses on the toner container 730.

Fourth Modification

Figure 16C:
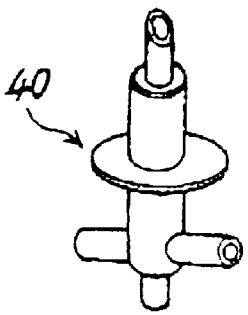
FIGS. 16A through 16C are isometric views showing a fourth modification of the illustrative embodiment.
Figure 16B:
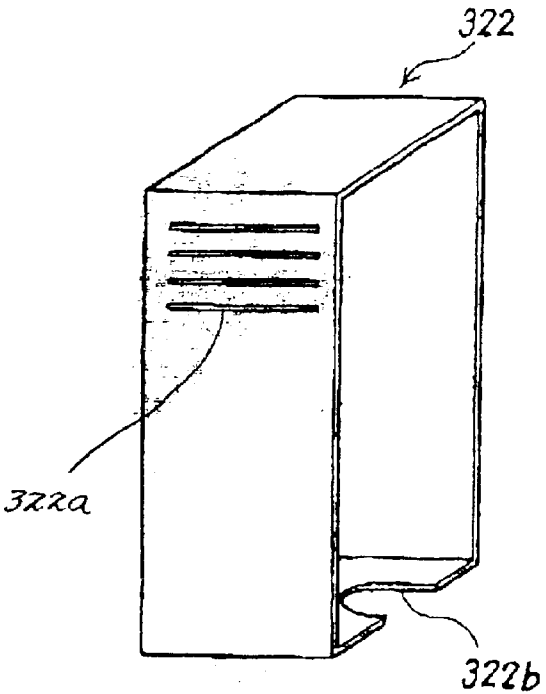
Figure 16A:
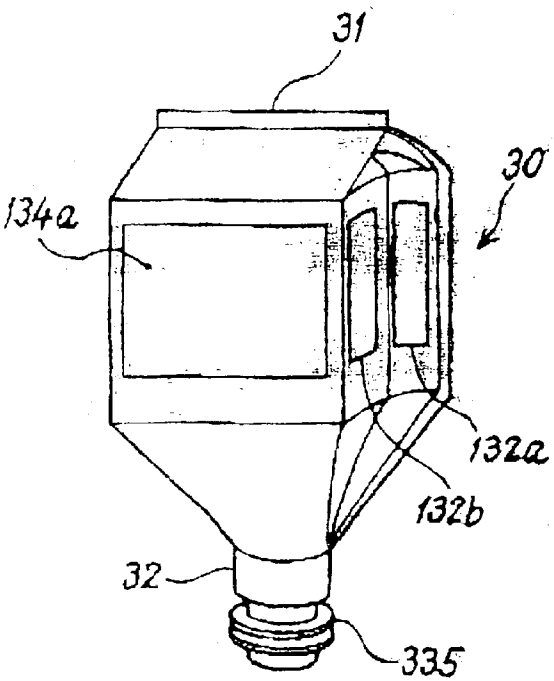

A fourth modification of the illustrative embodiment will be described hereinafter. FIG. 16A shows the toner container 30 with the guide member 134 in accordance with the first modification stated earlier. FIG. 16B shows a container holder 322 for holding the toner container 30 and unique to the fourth modification. FIG. 16C shows the nozzle 40 included in the toner replenishing device 20.

As shown in FIG. 16B, the container holder 322 is implemented as a box open at one side and so sized as to accommodate the toner container 30. Projections or recesses 322 are formed on the front wall of the container holder 322, as viewed in FIG. 16B, and the rear wall facing the front wall, so that the user's fingers do not slip on such walls during handling. The bottom wall of the container holder 322 is formed with a notch 332*b* for receiving the mouth portion 32 of the toner container 30. The mouth portion 32 is formed with an annular groove 335 that mates with the edge of the notch 322*b*, so that the toner container 30 can be firmly held in the container holder 322.

Before mounting the toner container 30 to the toner replenishing device 20, the user sets the toner container 30 the container holder 322. The user then holds the container holder 322 and thrust the toner outlet of the mouth portion 32 into the nozzle 40, thereby mounting the toner container 30 to the toner replenishing device 20 together with the container holder 322. When the toner container 30 runs out of toner, the user removes the toner container 30 from the toner replenishing device 20 by performing the above procedure in the reverse order. The container holder 322 itself is repeatedly used although the toner container 30 is replaced. In light of this, only the container holder 322 may be affixed to the toner replenishing device 20.

Second Embodiment

A second embodiment of the present invention also implemented as an electrophotographic printer will be described hereinafter. Because the second embodiment is identical with the first embodiment as to the image forming process, the following description will concentrate on the configuration of the nozzle unique to the second embodiment.

Figure 17:
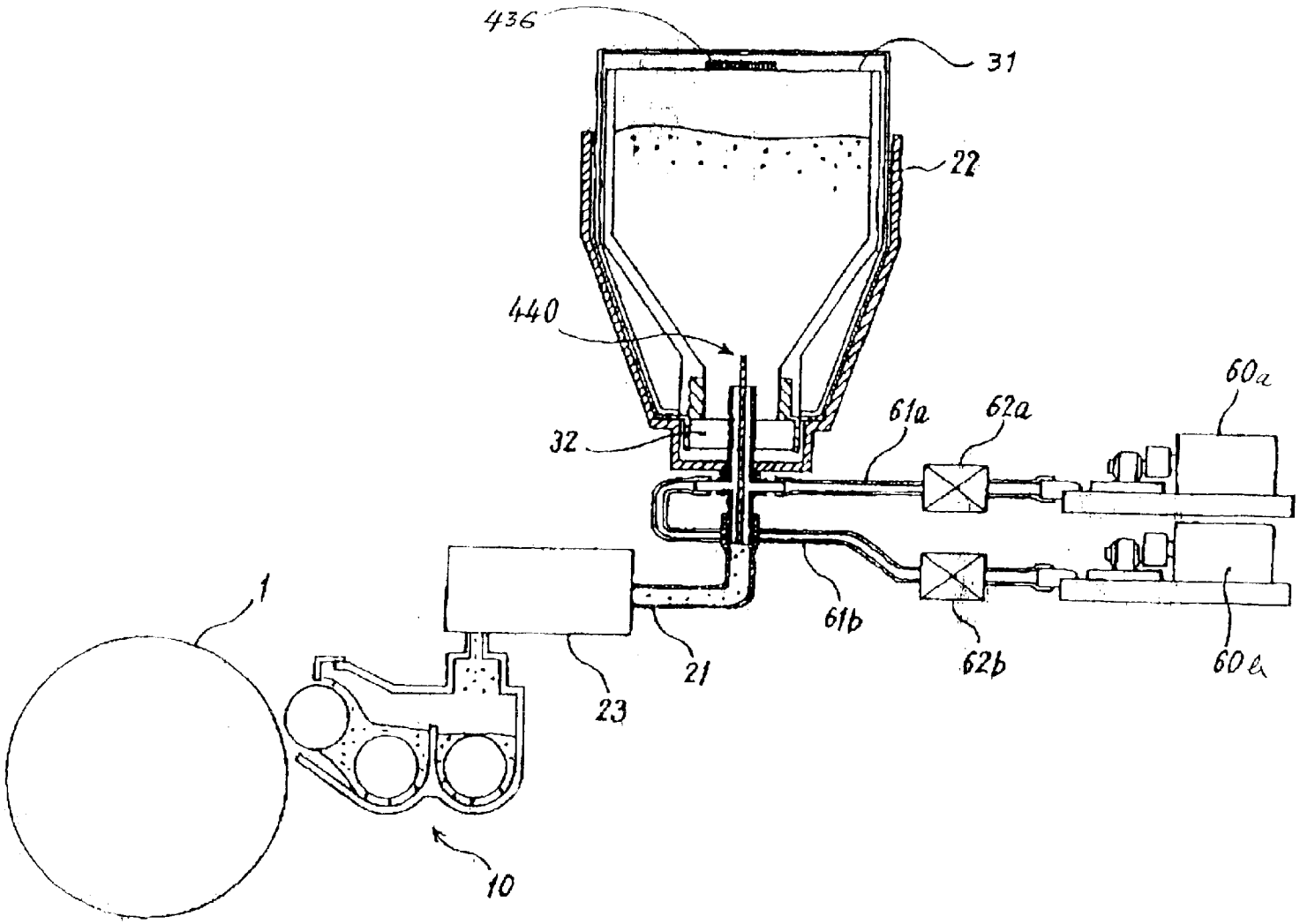
FIG. 17 is a view showing a second embodiment of the present invention.
Figure 18A:
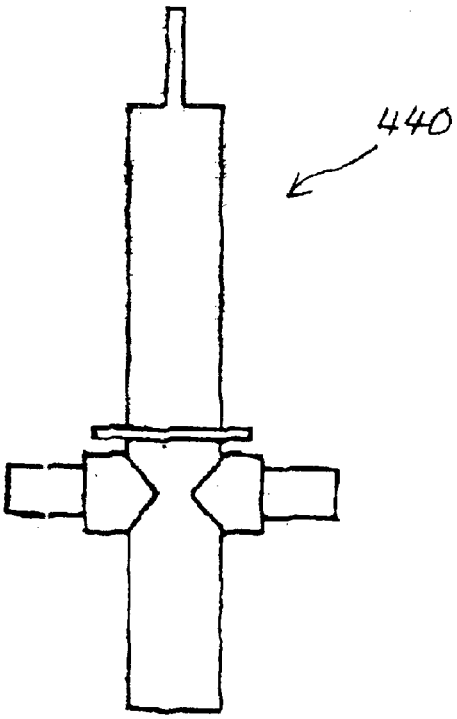
FIG. 18A is an external view of a nozzle included in the second embodiment.
Figure 18B:
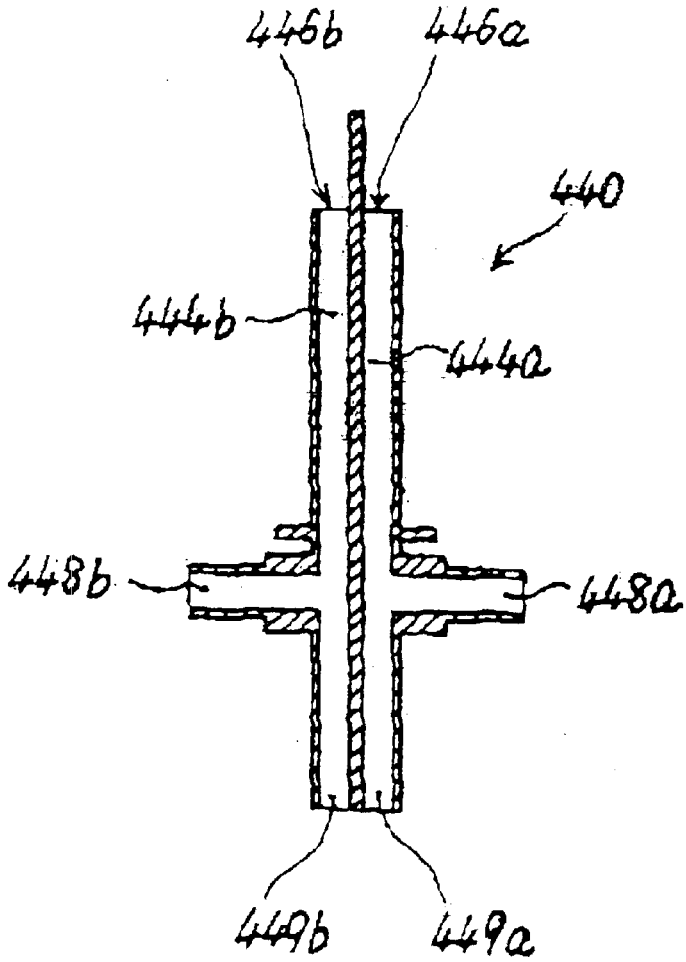
FIG. 18B is a section of the nozzle in the axial direction.

FIG. 17 shows a toner replenishing device included in the second embodiment. FIGS. 18A and 18B show a nozzle 440 unique to the illustrative embodiment. As shown, the nozzle 440 is implemented as a single tube whose bore is divided into two parts along the axis of the tube. More specifically, the nozzle 440 includes shared paths 444*a* and 444*b* respectively having shared openings 446*a* and 446*b* that play the role of toner-out air-in ports. Air inlets 448*a* and 448*b* are formed in the nozzle 440 and communicated to the air pumps 60*a* and 60*b*, respectively. Toner outlets 449*a* and 449*b* are also formed in the nozzle 440 and communicated to the developing unit 10 via the tube 21.

In the illustrative embodiment, the air supply to the toner container 30 and the toner discharge from the toner container 30 are not effected at the same time, but are effected, e.g., alternately. More specifically, the controller mentioned earlier first drives the air pumps 60*a* and 60*b* in response to a signal representative of short toner container from the developing device 10. The air pumps 60*a* and 60*b* respectively send compressed air to the shared paths 444*a* and 444*b* of the nozzle 440 via the air inlets 448*a* and 448*b*. Such air flows into the toner container 30 via the shared openings 446*a* and 446*b*, agitating and thereby fluidizing the toner existing in the toner container 30. On the elapse of a preselected period of time, the controller stops driving the air pumps 60*a* and 60*b* and closes the valves 62*a* and 62*b*.

Subsequently, the controller drives the drive motor 26 assigned to the screw pump 23. As a result, the toner in the toner container 30 is sucked into the screw pump 23 via the shared openings 446*a* and 446*b*, and shared passages 444*a* and 444*b* and toner outlets 449*a* and 449*b* of the nozzle 440 and tube 21. At this instant, the valves 62*a* and 62*b* held in the closed position prevent the toner from flowing toward the air pumps 60*a* and 60*b*.

As shown in FIG. 17, in the illustrative embodiment, the toner container 30 additionally includes a filter 436 positioned on its top in the vertical direction. The filter 436 passes air therethrough, but does not pass the toner, and therefore prevents the pressure inside the toner container 30 from rising when air is sent into the container 30. This prevents the amount of air from decreasing when the pressure rises, i.e., allows a great amount of air to be sent into the toner container 30 and thereby further promotes the fluidization of the toner in the toner container 30.

Third Embodiment

A third embodiment of the present invention applied to a color image forming apparatus will be described hereinafter. The color image forming apparatus includes four developing units and operates in the same manner as conventional. The following description will concentrate on the characteristics features of the third embodiment.

Figure 19:
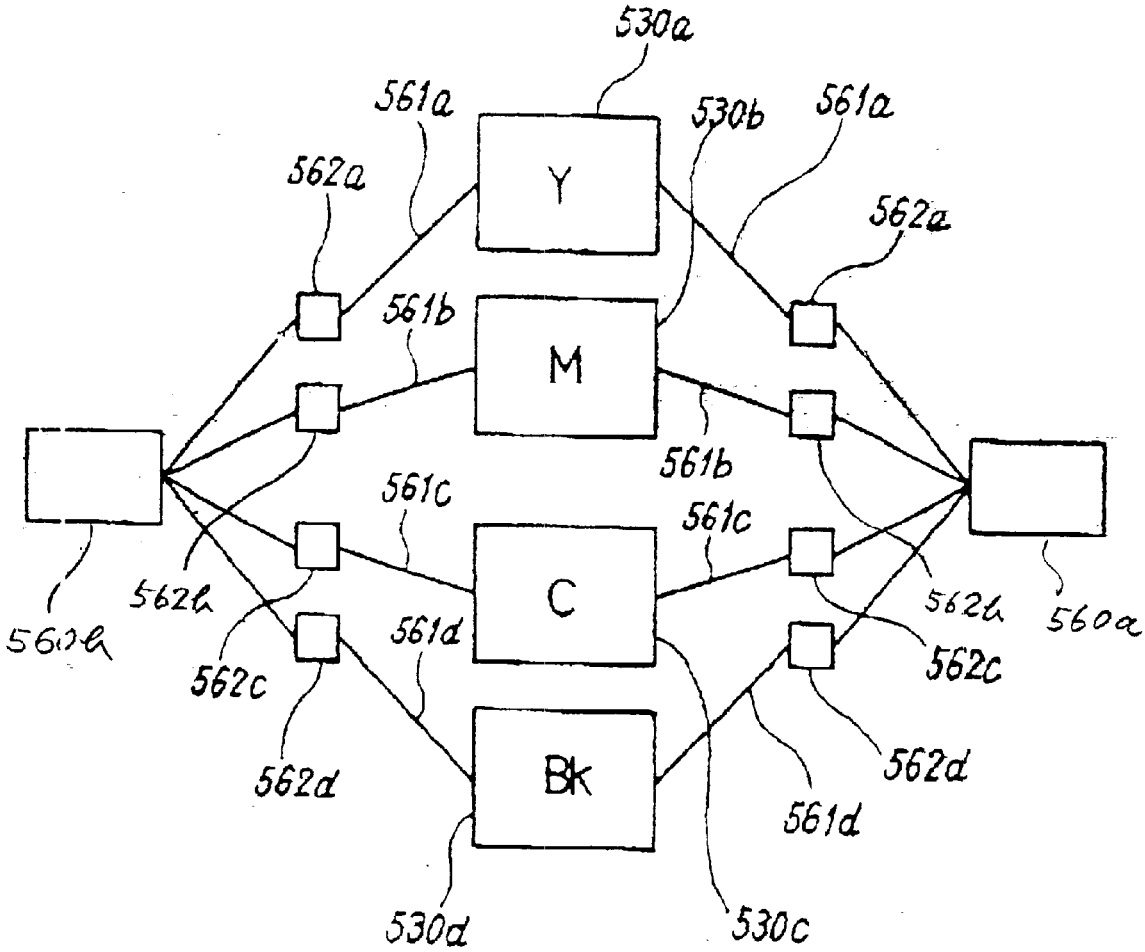
FIG. 19 shows a system for sending air into a plurality of toner containers and representative of a third embodiment of the present invention.

Reference will be made to FIG. 19 for describing an air sending system unique to the illustrative embodiment. As shown, the color image forming apparatus is loaded with four toner containers 530*a* through 530*d* each storing toner of a particular color represented by Y (yellow), M (magenta), C (cyan) or Bk (black). A toner conveying system for conveying toner from the toner containers 530*a* through 530*d* to the respective developing units is constructed in substantially the manner as in the first embodiment.

The illustrative embodiment uses only two air pumps 560*a* and 560*b* for sending air into the toner containers 530*a* through 530*d*. The first embodiment, for example, would need two air pumps for each of the toner containers 530*a* through 530*c*. More specifically, in the illustrative embodiment, the two air pumps 560*a* and 560*b* each are shared by one of the air passages of the nozzles assigned to the toner containers 530*a* through 530*d*. This successfully reduces the necessary number of pumps from eight to two for thereby saving space available in the printer and reducing the cost of the printer.

Assume that the air pumps 560*a* and 560*b* send air to all of the toner containers 530*a* through 530*d* at the same time. Then, it is likely that the amount of air sent to each toner container is short and fails to sufficiently fluidize toner. Should air pumps capable of sending a great amount of air be used, they would undesirably scale up the printer and increase power consumption.

In light of the above, valves 562*a* through 562*d* are respectively disposed in air supply passages 561*a* through 561*d* that provide communication between the air pumps 560*a* and 560*b* and toner containers 530*a* through 530*d*. When air is to be sent to, e.g., the Y toner container 530*a*, the valves 562*b*, 562*c* and 562*d* of the air supply passages 561*b*, 561*c* and 561*d* assigned to the other toner containers 530*b*, 530*c* and 530*c* are closed. As a result, air is sent from the air pumps 560*a* and 560*b* via only the air supply passages 561*a*.

As stated above, the toner container of any one of the illustrative embodiments and modifications thereof is easy to handle and efficient to store while saving space. The guide member attached to the toner container is low cost and can be repeatedly used and applied even to conventional toner containers, contributing to easy, low cost production of toner containers.

The third modification of the first embodiment, in particular, allows the toner container most effectively collapse in the ideal sheet-like configuration, as determined by experiments.

In the fourth modification of the first embodiment, the container holder holds the toner container. Therefore, even if the toner storing portion of the toner container is formed of a flexible material, it can be handled as easily as, e.g., a hard bottle formed of a hard material.

In the first to third modifications, assume that pressure acting on one of the air outlets due to the toner is high while pressure acting on the other of them due to the toner is low. Then, the controller or gas delivery control means increases the amount of air to be sent to the one outlet and reduces the amount of air to be sent to the other outlet. This allows such air to sufficiently fluidize the toner without regard to the pressure of the toner acting on the air outlets 46*a* and 46*b*, thereby effectively reducing toner blocking. The toner-in air-out passages unique to the second embodiment are successful to simplify the construction and save space and cost. The valves prevent the toner from flowing toward the air pumps.

If desired, a valve or similar flow control means may be disposed in the toner passage 41*a*, FIGS. 6B and 6C, so as to control the amount of toner to be delivered to the toner replenishing device 20. This allows a constant amount of toner to be delivered to the toner replenishing device 20.

Figure 20:
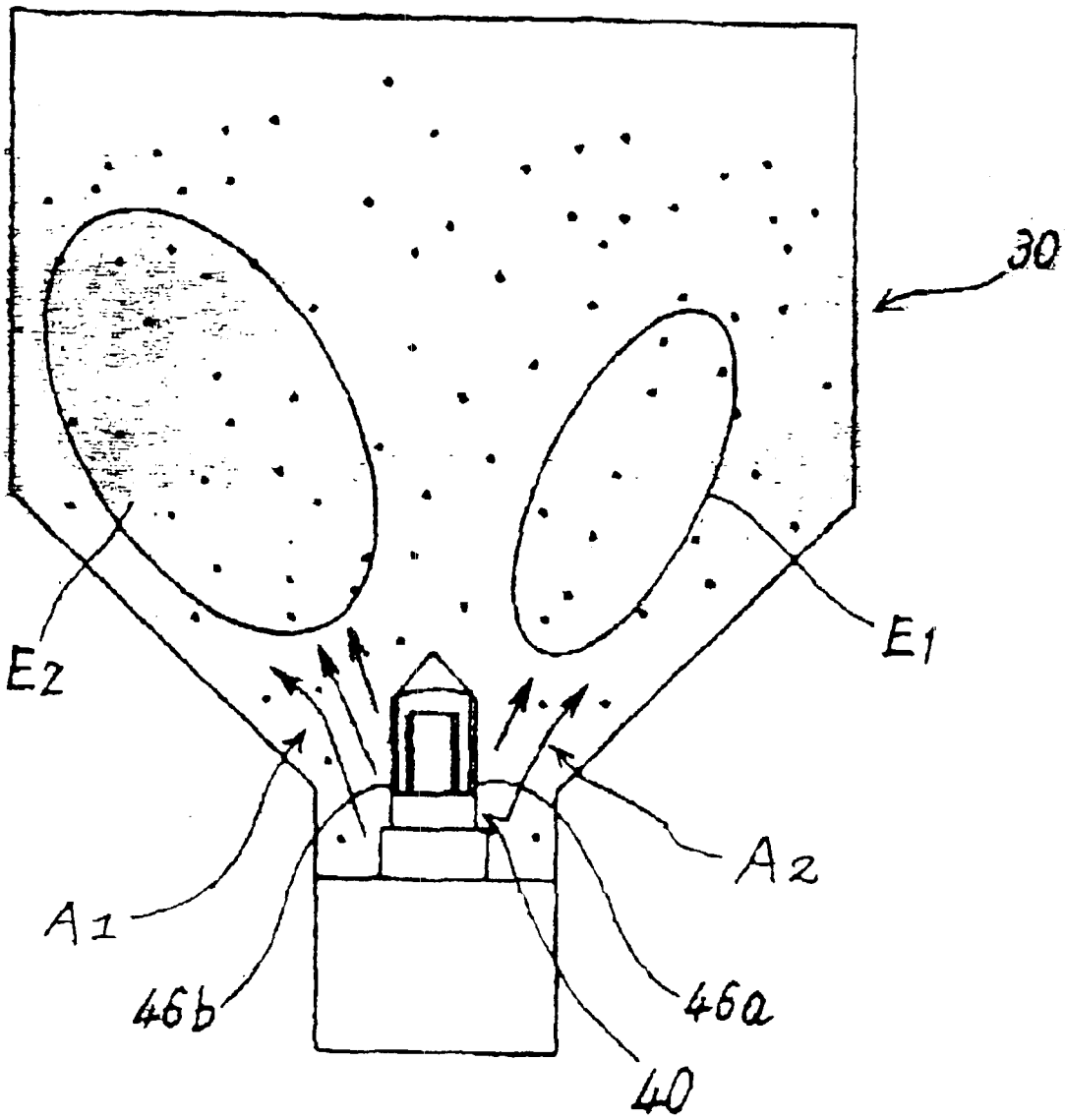
FIG. 20 shows one of the toner containers into which the system of FIG. 19 sends air.

In the first to third embodiments, air may be sent into the toner container via the two air outlets in the same amount. This, however, is likely to cause bridging to occur in the toner due to a uniform pressure distribution or similar cause. FIG. 20 shows a specific arrangement configured to solve such a problem. In FIG. 20, arrows Al are representative of a great amount of air flowing into the toner container 30 while arrows A2 are representative of a small amount of air also flowing into the toner container 30. As shown, the air pumps 60*a* and 60*b* each send a particular amount of air into the toner container 30. Consequently, the toner is fluidized in a particular manner in each of regions $E_1$ and $E_2$, resulting in a non-uniform irregular pressure distribution. This successfully obstructs the bridging of the toner. If desired, not the amount of air to be sent into the toner container, but the timing for starting and ending the air supply may be controlled pump by pump.

In summary, it will be seen that the present invention provides a toner container easy to handle and efficient to store and transport when run out of toner. In addition, a gas is sent into the toner container via a plurality of air inlets and can therefore sufficiently agitate and fluidize the toner existing in the toner container.

Various modifications will become possible for those skilled in the art after receiving the teachings of the present disclosure without departing from the scope thereof.

What is claimed is:

1. A developer container comprising:

a flexible bag whose volume decreases in accordance with a decrease in pressure thereinside;

an outlet forming member forming an outlet for discharging a developer stored in said bag; and deformation assisting means for helping, when the volume of said bag decreases due to a drop of the pressure, said bag deforms to a preselected shape.

2. The developer container as claimed in claim 1, wherein said deformation assisting means causes said bag to bend at preselected positions.

3. The developer container as claimed in claim 2, wherein said deformation assisting means comprises a deformation assisting member removably fitted on said bag.

4. The developer container as claimed in claim 3, wherein said deformation assisting member comprises a hollow member fitted on at least part of an outer periphery of said bag and more rigid than said bag.

5. The developer container as claimed in claim 1, wherein said deformation assisting means is affixed to at least part of said bag.

6. The developer container as claimed in claim 5, wherein said deformation assisting means comprises reinforcing means for providing part of said bag with higher rigidity than the other part of said bag.

7. The developer container as claimed in claim 6, wherein said bag includes at least one flat wall, and said reinforcing means comprises a flat member affixed to at least part of said flat wail.

8. The developer container as claimed in claim 7, wherein said flat member is formed with a perforation.

9. The developer container as claimed in claim 6, wherein said reinforcing means comprises a portion of said bag thicker than the other portion of said bag.

10. The developer container as claimed in claim 6, wherein said bag includes two first walls facing each other and two second walls facing each other and connecting said two first walls, said reinforcing means is positioned on each of said first walls, said second walls each are formed with a fold for causing, when the volume of said bag decreases, the second wall to bend such that said first walls move toward each other, and said reinforcing means comprises two reinforcing means positioned at both sides of said fold.

11. The developer container as claimed in claim 6, wherein said bag includes two first walls facing each other and two second walls facing each other and connecting said two first walls, said first walls comprise sheet members more rigid than said second walls, said second walls each are formed with a fold for causing, when the volume of said bag decreases, the second wall to bend such that said first walls move toward each other; and said reinforcing means comprises at least one reinforcing means positioned at either side of said fold.

12. The developer container as claimed in claim 1, wherein said deformation assisting means comprises deformation assisting means removably fitted on said bag.

13. The developer container as claimed in claim 12, wherein said deformation assisting means comprises a hollow member fitted on at least part of an outer periphery of said bag and more rigid than said bag.

14. The developer container as claimed in claim 1, wherein said deformation assisting means is affixed to at least part of said bag.

15. The developer container as claimed in claim 14, wherein said deformation assisting means comprises reinforcing means for providing part of said bag with higher rigidity than the other part of said bag.

16. The developer container as claimed in claim 15, wherein said bag includes at least one flat wall, and said reinforcing means comprises a flat member affixed to at least part of said flat wall.

17. The developer container as claimed in claim 16, wherein said flat member is formed with a perforation.

18. The developer container as claimed in claim 15, wherein said reinforcing means comprises a portion of said bag thicker than the other portion of said bag.

19. The developer container as claimed in claim 15, wherein said bag includes two first walls facing each other and two second walls facing each other and connecting said two first walls, said reinforcing means is positioned on each of said first walls, said second walls each are formed with a fold for causing, when the volume of said bag decreases, the second wall to bend such that said first walls move toward each other; and said reinforcing means comprises two reinforcing means positioned at both sides of said fold.

20. The developer container as claimed in claim 15, wherein said bag includes two first walls facing each other and two second walls facing each other and connecting said two first walls, said first walls comprise sheet members more rigid than said second walls, said second walls each are formed with a fold for causing, when the volume of said bag decreases, the second wall to bend such that said first walls move toward each other; and said reinforcing means comprises at least one reinforcing means positioned at either side of said fold.

21. An image forming apparatus comprising:

an image carrier;

a developing unit for developing a latent image formed on said image carrier with a developer;

a developer replenishing device for replenishing a developer to said developing unit; and a developer container storing the developer to be replenished and removably mounted to said developer replenishing device;

said developer container comprising:

a flexible bag whose volume decreases in accordance with a decrease in pressure thereinside;

an outlet forming member forming an outlet for discharging the developer stored in said bag; and deformation assisting means for helping, when the volume of said bag decrease due to a drop of the pressure, said bag deform to a preselected shape.

22. The apparatus as claimed in claim 21, further comprising a holder for holding said developer container when said developer container is to be mounted to said developer replenishing device.

23. A developer conveying device comprising:

a gas sending device for sending a gas under pressure;

an air supply passage for guiding the gas delivered from said gas sending device to a developer container, which stores a developer therein, via a plurality of gas outlets;

a developer passage formed with a developer inlet for discharging the developer from said developer container; and gas delivery control means for controlling individual flows of the gas into said developer container via said plurality of gas inlets.

24. The device as claimed in claim 23, wherein said gas supply passage comprises a plurality of gas supply passages each being communicated to a particular gas outlet, and said gas sending device comprises a plurality of gas sending devices each being communicated to a particular gas supply passage.

25. The device as claimed in claim 24, wherein said gas delivery control means controls the flows of the gas such that an amount of the gas differs between at least part of said plurality of gas outlets.

26. The device as claimed in claim 25, wherein said gas delivery control means executes control such that periods of time for gas supply to be effected via at least part of said plurality of gas outlets partly do not overlap each other.

27. The device as claimed in claim 26, wherein said gas supply passage forms part of said developer passage.

28. The device as claimed in claim 27, wherein at least part of said plurality of gas outlets is positioned to feed the gas to the developer around said developer outlet.

29. The device as claimed in claim 28, further comprising blocking means for blocking said gas supply passage when said gas sending device does not send the gas.

30. The device as claimed in claim 29, further comprising flow control means disposed in said developer supply passage for controlling an amount of the developer to flow through said developer supply passage.

31. The device as claimed in claim 23, wherein said gas delivery control means controls the flows of the gas such that an amount of the gas differs between at least part of said plurality of gas outlets.

32. The device as claimed in claim 31, wherein said gas delivery control means executes control such that periods of time for gas supply to be effected via at least part of said plurality of gas outlets partly do not overlap each other.

33. The device as claimed in claim 32, wherein said gas supply passage forms part of said developer passage.

34. The device as claimed in claim 33, wherein at least part of said plurality of gas outlets is positioned to feed the gas to the developer around said developer outlet.

35. The device as claimed in claim 34, further comprising blocking means for blocking said gas supply passage when said gas sending device does not send the gas.

36. The device as claimed in claim 35, further comprising flow control means disposed in said developer supply passage for controlling an amount of the developer to flow through said developer supply passage.

37. The device as claimed in claim 23, wherein said gas delivery control means executes control such that periods of time for gas supply to be effected via at least part of said plurality of gas outlets partly do not overlap each other.

38. The device as claimed in claim 37, wherein said gas supply passage forms part of said developer passage.

39. The device as claimed in claim 38, wherein at least part of said plurality of gas outlets is positioned to feed the gas to the developer around said developer outlet.

40. The device as claimed in claim 39, further comprising blocking means for blocking said gas supply passage when said gas sending device does not send the gas.

41. The device as claimed in claim 40, further comprising flow control means disposed in said developer supply passage for controlling an amount of the developer to flow through said developer supply passage.

42. The device as claimed in claim 23, wherein said gas supply passage forms part of said developer passage.

43. The device as claimed in claim 42, wherein at least part of said plurality of gas outlets is positioned to feed the gas to the developer around said developer outlet.

44. The device as claimed in claim 43, further comprising blocking means for blocking said gas supply passage when said gas sending device does not send the gas.

45. The device as claimed in claim 44, further comprising flow control means disposed in said developer supply passage for controlling an amount of the developer to flow through said developer supply passage.

46. The device as claimed in claim 23, wherein at least part of said plurality of gas outlets is positioned to feed the gas to the developer around said developer outlet.

47. The device as claimed in claim 46, further comprising blocking means for blocking said gas supply passage when said gas sending device does not send the gas.

48. The device as claimed in claim 47, further comprising flow control means disposed in said developer supply passage for controlling an amount of the developer to flow through said developer supply passage.

49. The device as claimed in claim 23, further comprising blocking means for blocking said gas supply passage when said gas sending device does not send the gas.

50. The device as claimed in claim 49, further comprising flow control means disposed in said developer supply passage for controlling an amount of the developer to flow through said developer supply passage.

51. The device as claimed in claim 23, further comprising flow control means disposed in said developer supply passage for controlling an amount of the developer to flow through said developer supply passage.

52. An image forming apparatus comprising:

an image carrier;

a developing unit for developing a latent image formed on said image carrier with a developer;

a developer container storing the developer; and a developer replenishing device for conveying the developer discharged from said developer container to said developing unit to thereby replenishing said developer;

said developer replenishing device comprising:

a gas sending device for sending a gas under pressure;

an air supply passage for guiding the gas delivered from said gas sending device to said developer container via a plurality of gas outlets;

a developer passage formed with a developer inlet for discharging the developer from said developer container; and gas delivery control means for controlling individual flows of the gas into said developer container via said plurality of gas inlets.

53. The apparatus as claimed in claim 52, wherein said developer container comprises gas discharging means for discharging the gas from said toner container to an outside.

54. The apparatus as claimed in claim 52, wherein at least part of said developer container comprises a flexible bag whose volume decreases with a decrease in pressure inside of said bag.

55. An image forming apparatus comprising:

an image carrier;

a developing unit for developing a latent image formed on said image carrier with a developer;

a developer container storing the developer; and a developer replenishing device for conveying the developer discharged from said developer container to said developing unit to thereby replenishing said developer;

wherein said developing unit comprises a plurality of developing units each storing a developer of a particular color, said developer container comprises a plurality of developer containers each being mounted to a particular developing unit;

said developer replenishing device comprises a developer conveying device comprising:

a gas sending device for sending a gas under pressure;

an air supply passage for guiding the gas delivered from said gas sending device to said developer container via a plurality of gas outlets;

a developer passage formed with a developer inlet for discharging the developer from said developer container; and gas delivery control means for controlling individual flows of the gas into said developer container via said plurality of gas inlets;

a plurality of gas supply passages each are assigned to a particular toner container, and a single air sending device shared by said plurality of gas supply passages.

56. The apparatus as claimed in claim 55, wherein said gas supply passages each include blocking means for blocking the gas supply passage when the gas is sent via any other gas supply passage.

57. The apparatus as claimed in claim 55, wherein said developer container comprises gas discharging means for discharging the gas from said toner container to an outside.

58. The apparatus as claimed in claim 55, wherein at least part of said developer container comprises a flexible bag whose volume decreases with a decrease in pressure inside of said bag.

* * * * *